United States Patent [19]

Foco et al.

[11] Patent Number: 5,042,172

[45] Date of Patent: Aug. 27, 1991

[54] CLOTHES DRYER WITH FLEXIBLE EXHAUST DUCT SYSTEM

[75] Inventors: Keith E. Foco, St. Joseph; Frank E. Miller, Lincoln Township, Berrien County; Keith E. Carr, Lincoln Township, Berrien County; Gary D. Golichowski, Lincoln Township, Berrien County; Karl Jautakis, Chikaming Township, Berrien County, all of Mich.

[73] Assignee: Whirlpool Corporation, Benton Harbor, Mich.

[21] Appl. No.: 456,621

[22] Filed: Dec. 29, 1989

Related U.S. Application Data

[63] Continuation of Ser. No. 139,004, Dec. 29, 1987, abandoned.

[51] Int. Cl.[5] ..... F26B 19/00

[52] U.S. Cl. ..... 34/235; 138/135

[58] Field of Search ..... 34/235; 285/18; 237/55, 237/46; 138/117, 120, 135, 155

[56] References Cited

U.S. PATENT DOCUMENTS

| | | | |
|---|---|---|---|
| 165,893 | 7/1875 | Umland | 138/155 X |
| 2,798,304 | 7/1957 | Reiter . | |
| 2,798,306 | 7/1957 | Reiter . | |
| 2,798,307 | 7/1957 | Reiter . | |
| 2,813,354 | 11/1957 | Buck . | |
| 4,081,915 | 4/1978 | Babcerowicz et al. | 34/235 |
| 4,537,117 | 8/1985 | Cavestany et al. | 237/46 X |
| 4,633,768 | 1/1987 | Benson | 237/46 |
| 4,727,908 | 3/1988 | Forster | 138/120 |

*Primary Examiner*—Henry A. Bennett

*Attorney, Agent, or Firm*—Hill, Van Santen, Steadman & Simpson

[57] ABSTRACT

A flexible exhaust ducting system is provided for a dryer wherein the dryer has more than one opening through its cabinet panels for an exhaust outlet to accommodate differing installation configurations. The ducting system includes a flexible metal tubing which is radially deformed into contact with rigid metallic end pipes to provide a trouble free joint. The end pipes are secured to the cabinet bottom panel at an end connected to the blower and to the panel through which the conduit exits the cabinet at the other end to prevent accidental dislodging of the conduit.

5 Claims, 2 Drawing Sheets

CLOTHES DRYER WITH FLEXIBLE EXHAUST DUCT SYSTEM

This is a continuation of application Ser. No. 139,004, filed Dec. 29, 1987, abandoned.

BACKGROUND OF THE INVENTION

1. Field of the Invention

The invention relates to a flexible exhaust duct and more particularly to a system of flexible and rigid parts of an exhaust duct and means for attaching the duct to a clothes dryer.

2. Description of the Prior Art

In clothes dryers, a source of heat sufficient to dry the wet clothes in the dryer is drawn through the dryer by a blower. After the heat has been drawn through the dryer containing the clothes, it is necessary to vent the heated and humid air. To this end, an air exhaust conduit is provided that extends from the blower housing within the cabinet of the dryer to an area outside the dryer. For example, it is known to extend the air exhaust conduit from the cabinet to a window so that the heated air is vented outdoors.

Due to the construction of the basement or other location where the consumer may locate the dryer, it may be necessary or desirable to extend the air exhaust conduit from a specific side, rear or bottom of the dryer. To this end, plugged apertures are provided in the dryer cabinet side walls, rear walls and bottom wall to permit the consumer to move the exhaust conduit to exit through the appropriate panel as required by the particular installation characteristics.

Since the distance and direction from the blower exhaust opening to each of the panel apertures is different, it is necessary to provide a means for directing the exhaust air from the blower to each of the exhaust outlets. Rigid conduit is not useful since generally it is required to have a 90° turn for the side or bottom openings but a straight flow path for the rear opening. Therefore, this would require the user to assemble or disassemble an elbow within the limited access area within the dryer cabinet. To do so would most likely require removal of one or more of the panels to provide greater access for the required manipulations of the exhaust conduit. Preferably flexible exhaust ducts would be used.

Flexible exhaust ducts are known which are comprised of rigid end pipes attached to flexible corrugated tubing such as aluminum tubing. The connections between the end pipes and the flexible tubing has been accomplished in a variety of manners including securing the two members together by wrapping the joint with an adhesive tape, securing the two members together with metallic staples extending through the two pieces or by applying an adhesive between the two pieces to secure them together. Each of these methods has serious disadvantages, particularly where the exhaust duct is used in an environment such as a clothes dryer where the exhaust will include lint particles and air at an elevated temperature.

For example, the staple method of attachment results in protruding ends of the staples extending into the exhaust air flow stream which serve as collection points for the lint particles resulting in an accumulation of lint at that location which eventually results in restriction or blockage of the conduit. In addition to reduction in efficiency of the dryer due to reduced air flow, the accumulation of lint can increase the possibility of overheating. Similar problems develop with the use of adhesives and tape to secure the members together in that if a zone of adhesive material is exposed to the air stream, lint will collect at that zone and will result in an accumulation of lint as described above. Also, such a joint may fail over time either due to improper initial application of the adhesive or breakdown of the adhesive due to the high temperature environment of a dryer exhaust duct. Also, in each of these instances an edge of either the flexible conduit or end pipes remains exposed in the air stream and also serves as a catch point for lint.

Other problems develop with multi-venting installations in that movement of the conduit from one panel opening to another causes movement at the joint between the conduit and the blower exhaust opening which may cause a leak to develop at that joint. If a leak develops there, then hot, moist, lint-ladened air will be directed into the interior of the cabinet which could result in damage to various components within the dryer cabinet including the motor and controls. Attachment of the free end of the conduit to the panel through which the end piece projects also is critical so as to prevent the end piece from falling into the interior of the cabinet.

SUMMARY OF THE INVENTION

The present invention provides a flexible exhaust ducting system in which the end pipes and flexible tubing are joined by partially inserting the tubing into the end pipes and cold rolling the tubing and end pipes together to produce a cold rolled joint in which the terminal ends of the tubing are pressed against the inside surface of the end pipes in a recessed position relative to the air flow path and, due to the contour of the end pipe at the joint, the tubing is locked in place to the end pipes. This cold rolled joint recesses the sharp edges of the bare flexible aluminum duct, removing them from the air flow path and minimizing their ability to catch lint, and provides a rigid, secure and positive means of attachment of the tubing to the end pipes.

This ducting system results in reliability in that the joint is not adversely affected by temperature or age, the tensile strength of the joint exceeds that of the bare aluminum duct and since the cold rolled joint does not impede air flow at the connections, such as that described above with respect to conventional methods of attaching flexible tubing to end pipes, the performance of the duct system is greatly enhanced.

A U-shaped bracket with slotted mounting holes is used to secure the front end pipe to the dryer cabinet. This adjustable bracket assures that the connection to the blower housing is secure and virtually leak-free. The bracket is mounted to the cabinet base instead of the rear of the blower housing. This arrangement allows movement of the flexible aluminum duct during relocation of the duct to different cabinet vent holes and prevents transmission of this movement to the blower housing. This prevents deflection of the blower housing which could cause interference with the blower wheel as well as assures the maintenance of a tight seal between the conduit and the blower housing.

The rear end pipe is secured in the cabinet opening on one side by a fork bracket. The other side clamps the cabinet metal between a tab bracket and a screw and washer combination. This arrangement holds the end pipe securely and makes switching to the other cabinet openings an easy one tool operation. From the outside of the dryer, the installer will attach the exterior exhaust tubing to exhaust the dryer air to the outside. This would complete the system.

DETAILED DESCRIPTION OF THE PREFERRED EMBODIMENTS

Figure 1:
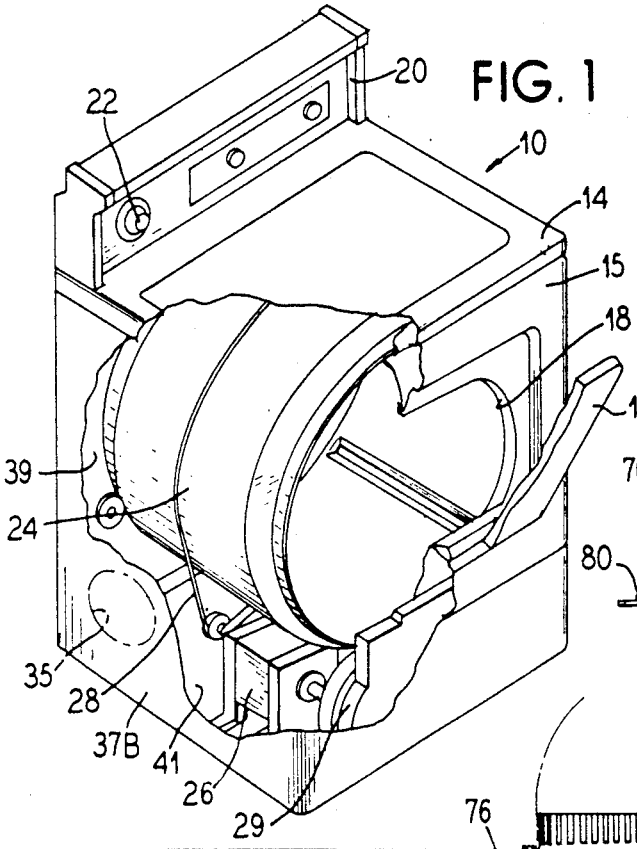
FIG. 1 is a perspective view of the dryer embodying the principles of the present invention.
Figure 3:
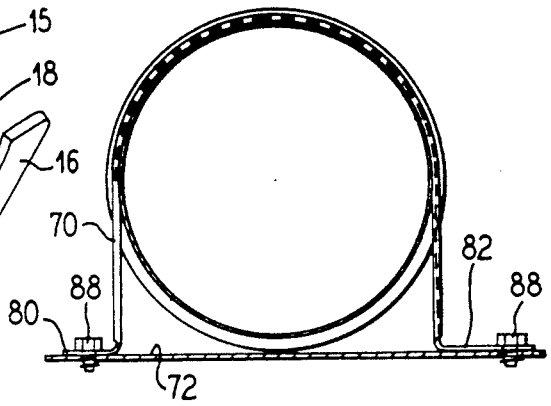
FIG. 3 is a sectional view taken generally along the line III—III of FIG. 2 showing the front end pipe mounting arrangement.

FIG. 1 illustrates a dryer 10 comprising a cabinet 14 having a front panel 15 with an openable door 16 revealing an access opening 18. The cabinet 14 also has side panels 37A and 37B, a rear panel 39 and a bottom panel 41. The console 20 has presetable controls 22 thereon allows an operator to preselect a program of automatic drying and tumbling in a laundry drying process. The door 16 in the front panel 15 of the cabinet 14 permits access through the access opening 18 into the interior of a drum 24 having open ends which is rotatably mounted within the cabinet 14.

Below the drum 24 but within the cabinet 14 there is provided an electric motor 26 which rotatable drives the drum by means of a belt 28 and also drives a blower 29. The blower 29 draws heated air into the drum 24 which is used in the drying process.

Figure 2:
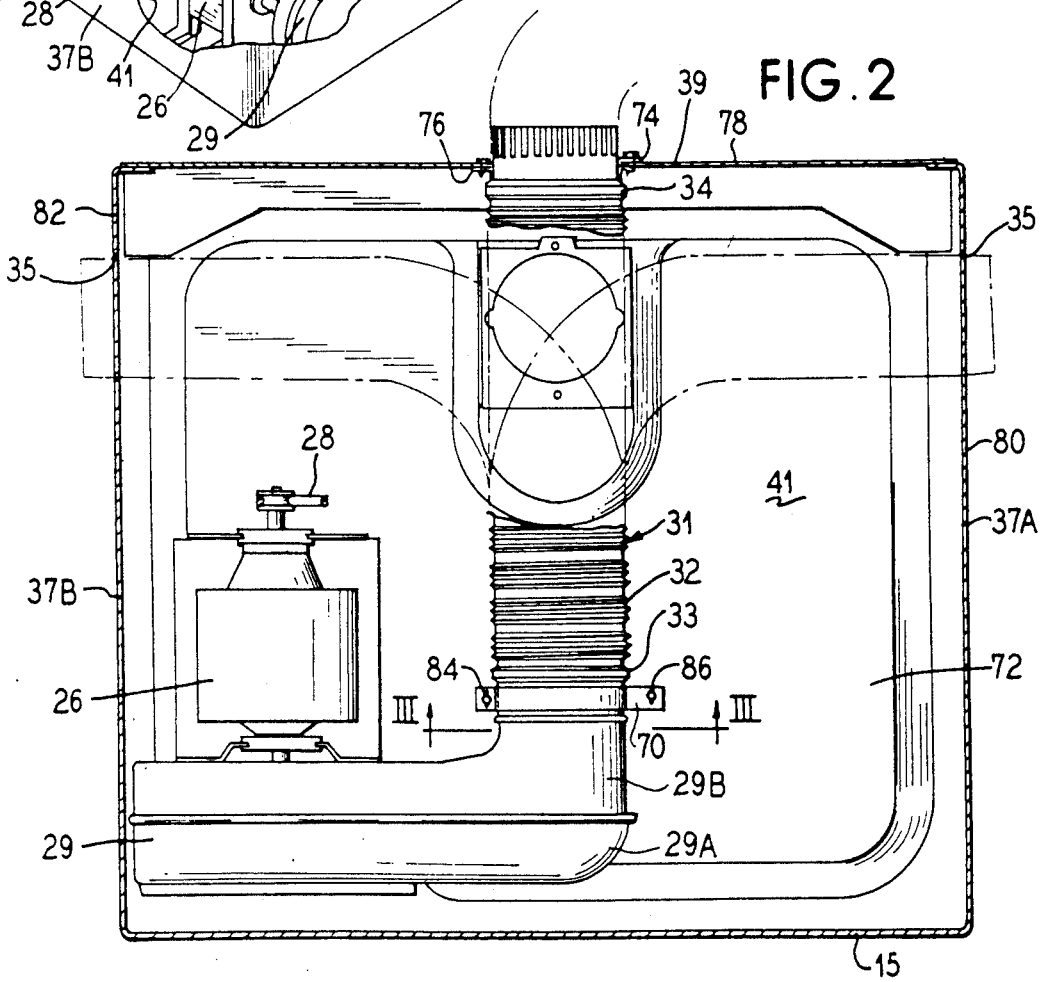
FIG. 2 is a top sectional view of the dryer taken below the dryer drum.
Figure 4:
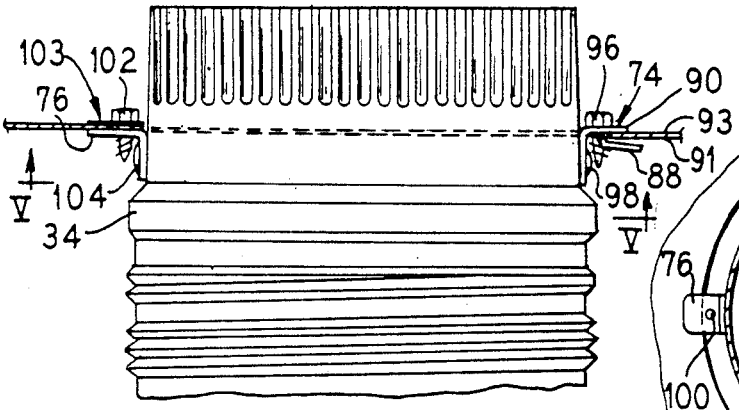
FIG. 4 is a top view illustrating the connection structure at the rear end pipe.
Figure 5:
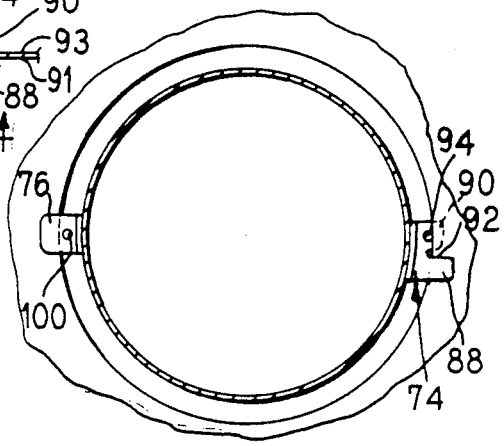
FIG. 5 is a sectional view taken generally along the line V—V of FIG. 4.

As best seen in FIG. 2, the blower 29 comprises a housing 29A having a cylindrical portion 29B forming a first duct means located in the interior of the cabinet. The heated air that has been used in the drying process is vented from the blower duct means 29B through an air exhaust duct or conduit 31 which passes through one of a plurality of exhaust openings 35, located in a side panel 37A and 37B, rear panel 39 or bottom panel 41. The air exhaust conduit 31 is a flexible and expandable tube preferably comprising a corrugated aluminum tube 32 connected to a rigid front end pipe 33 and a rigid rear end pipe 34.

Figure 6:
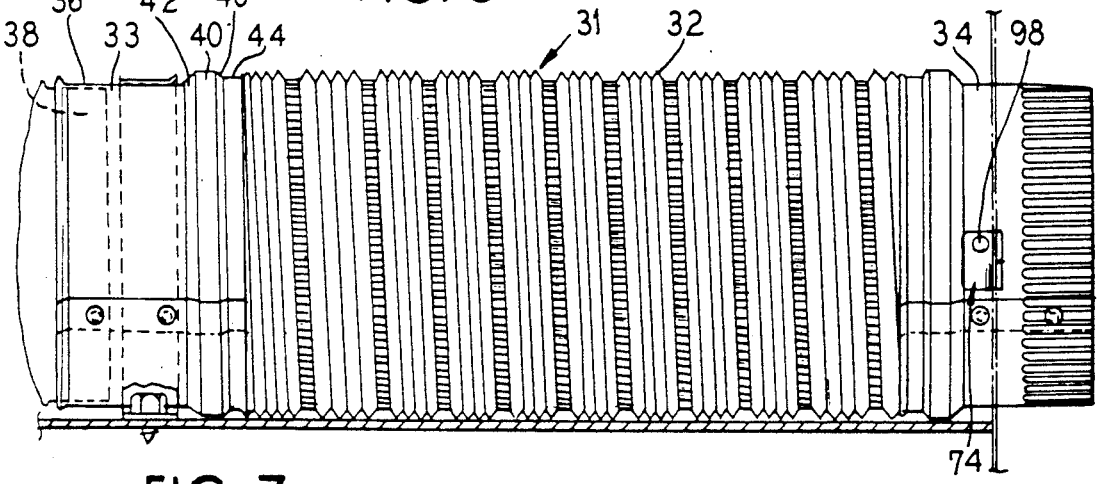
FIG. 6 is a side elevational view of the assembled flexible tubing and end pipes.
Figure 7:
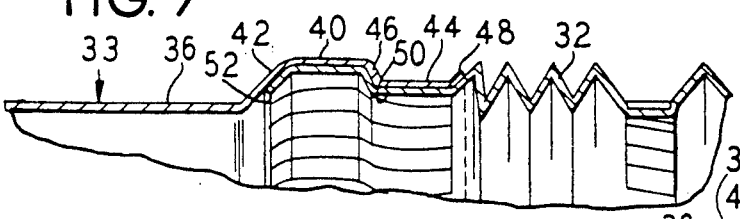
FIG. 7 is an enlarged sectional view of the connection of the flexible tubing with the front end pipe.
Figure 8:
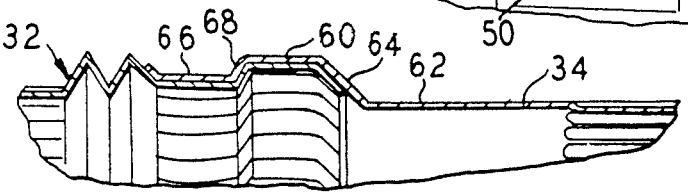
FIG. 8 is a an enlarged sectional view of the connection of the flexible tubing with the rear end pipe.

The assembly of the conduit 31 is shown in greater detail in FIGS. 6–8 where it is seen that the front end pipe 33 has a generally cylindrical forward end portion 36 having a diameter sized to provide a tight slip fit over a cylindrical extension 38 of the blower duct means 29B thereby to provide a tight fit between the duct extension 38 and the front end pipe 33. The front end pipe 33 has an enlarged diameter portion 40 which is connected to the cylindrical portion 36 by a first outwardly diverging wall 42. The enlarged diameter portion 40 is connected to a cylindrical rear end 44 by a second outwardly diverging wall 46. The rear end 44 has a slightly outwardly turned lip 48. The diameter of the cylindrical end portion 44 is slightly greater than that of the forward cylindrical end portion 36.

Figure 7A:
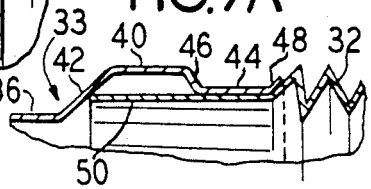
FIG. 7A is an enlarged sectional view prior to connection of the flexible tubing with the front end pipe.

As seen in FIG. 7A, the flexible metal tubing 32 has a forward generally cylindrical end 50 having a diameter slightly less than that of the rear cylindrical end 44 of the front end pipe 33 so that it can be slipped into the open end of the front end pipe. The forward cylindrical end 50 of the tubing and the front end pipe 33 are joined together by cold rolling the pieces together to produce a joint shown in FIG. 7 wherein the forward end 50 of the tubing is radially deformed to conform to the shape of the end pipe. This step can be done after the end pipe has been shaped with the enlarged diameter portion 40 as illustrated in FIG. 7A, or the shaping of the end pipe can be done simultaneously with the formation of the joint between the end pipe 33 and the tubing 32.

In either event, a joint such as that illustrated in FIG. 7 is achieved wherein the tubing 32 is locked to the end pipe due to the contours formed, such that the tubing 32 is prevented from moving axially relative to the end pipe 33. This cold rolling process forms such a tight joint that relative rotational movement of the tubing and end pipe is also prevented. A terminal front edge 52 of the tubing 32 ends up in a protected area on the inside of outwardly expanding wall 42 so that the sharp edge is positioned out of the main air stream flowing through the conduit thereby minimizing the possibility that lint will catch and collect at that edge.

The end pipe 34 has a forward end configuration substantially identical to the configuration of the rear end of the front end pipe 33 in that it has an enlarged diameter portion 60 connected to a cylindrical rear end 62 by a first outwardly diverging wall 64 and is connected to a generally cylindrical forward end 66 by a second outwardly diverging wall 68 such that an identical connection is provided by radially deforming the tubing 32 into close engagement with the rear end pipe 34 as is described above.

The benefits of this type of a joint are that the joint is highly reliable in that it is not adversely affected by temperature or age and the cold rolled joint does not impede air flow at the connections thus providing greatly improved performance of the duct over conventional methods of utilizing flexible metal ducts and connecting them to the rigid end pipes. Further, Applicants have tested this joint construction relative to its tensile strength and have determined that the tensile strength of the joint exceeds that of the bare aluminum duct. Therefore, failure of the joint during use is highly unlikely.

As best seen in FIGS. 2–5, the exhaust conduit 31 is secured in place by attaching the conduit to the cabinet 14 of the dryer by providing a U-shaped bracket 70 to secure the front end pipe 33 to the bottom panel 41 of the cabinet and by providing two diametrically opposed brackets 74, 76 at the rear end pipe 34 which clamp the rear end pipe to a selected one of the rear panel 39, right side panel 37A, left side panel 37B or bottom panel 41 as is required by the particular installation configuration.

The U-shaped bracket 70 is provided with a pair of outwardly extending end tabs 80, 82 each having a slotted mounting hole 84, 86 therethrough for receiving a threaded fastener 88. Attaching the adjustable bracket 70 to the floor panel 41 of the dryer cabinet assures that the connection from the exhaust conduit 31 to the blower housing 29A is secure and virtually leak free. Movement of the flexible duct 31 when relocating the rear end pipe 34 to an opening in a different panel of the dryer cabinet will not result in a transmission of this movement to the blower housing due to the connection to the floor panel thus assuring a continued leak-free connection between the conduit 31 and the blower housing 29A.

As described above, the rear end pipe 34 is secured to a panel of the dryer cabinet by means of two brackets 74, 76, the first bracket 74 being a fork bracket having one tab portion 88 separated from a second tab portion 90 by a recess 92. The two tab portions 88, 90 are offset from each other so as to occupy different planes such that the first tab portion 88 will overlie an interior surface 91 of the particular panel through which the end pipe 34 is projecting and the second tab 90 will overlie an exterior surface 93 of that panel. An edge as of the opening is received in the recess 92 so that the fork bracket will in effect be hinged to the panel. An aperture 94 is provided in the second tab for receiving a threaded fastener 96. Threaded fastener 96 is used to secure the fork bracket 74 to the panel when venting through the bottom panel 41 but is unnecessary for other exhaust openings 35. The fork bracket 74 is attached to the end pipe 34 by appropriate fastening means 98 such as a rivet.

The second bracket 96 is generally L-shaped which is designed to overlie the interior surface 91 of the panel through which the end pipe 34 is extending and the bracket includes an aperture 100 for receiving a threaded fastener 102, carrying a washer 103, which extends through the panel to clamp the bracket 76 against the panel. The bracket 76 is secured to the rear end pipe 34 by an appropriate fastening means 104 such as a rivet.

The conduit 31 can be easily repositioned by removing the two fasteners 96, 102, and the washer 103 pushing the end pipe 34 of the conduit into the interior of the dryer cabinet, redirecting it toward an opening in a different panel wall, rehinging the fork bracket onto the opening in the panel wall and refastening the two threaded fasteners 96 and 102 and the washer 103 to again secure the end pipe 34 to the cabinet panel.

Thus, it is seen that the present invention provides a flexible exhaust ducting system for a dryer wherein the dryer has a cabinet with a bottom panel and four side panels, at least two of the side panels having an opening means therethrough for passage of an exhaust duct, and the dryer also including a blower housing with an exhaust opening within the cabinet. The ducting system comprises a flexible and expandable tubing with two open ends and two rigid end pipes, one secured to each end of the tubing. One of the end pipes is sized to join to the blower housing exhaust opening and the other of the end pipes is sized to extend through one of the panel openings. The system also includes bracket means at each end pipe securing the end pipes to at least one of the panels. The end pipes and flexible tubing are joined by deforming the tubing into engagement with the end pipes, preferably by radially deforming the tubing outwardly into engagement with at least a portion of a varying diameter contour of the end pipes to securely lock the tubing and end pipes together. In this manner, a trouble free joint is provided between the tubing and end pipes which does not require any additional fastening devices and which is not affected by heat or age. By securing the conduit to the panels themselves rather than to any component such as the blower housing, movement between the end pipe and blower housing is prevented thereby assuring a continued tight seal between those two members.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A flexible exhaust ducting system for carrying a particulate bearing fluid comprising:

a flexible and expandable tubing with two open terminal ends;

two rigid end pipes, one secured to an outside of each terminal end of said tubing;

said end pipes each having a first end portion with an inner diameter greater than an inner diameter of a second end portion;

said tubing ends being directly coupled to said first end portions of said end pipes, said direct coupling consisting of a deformation of said tubing ends conforming in a non-perforate manner to a shape of said end pipes, to non-removably secured said end pipes to said tubing without requiring use of additional fasteners between said tubing and said end pipes and to position said terminal ends of said tubing radially outward of said diameter of said second end portion of said end pipes, whereby said terminal ends of said tubing will be positioned out of a flow path of said particulate bearing fluid to prevent an accumulation of particulates on said terminal ends.

2. A flexible exhaust ducting system for carrying a particulate bearing fluid comprising:

a flexible and expandable tubing with two open terminal ends;

two rigid end pipes, one secured to an outside of each terminal end of said tubing;

said end pipes each having a first end portion with an inner diameter greater than an inner diameter of a second end portion;

said tubing ends being directly coupled to said first end portions of said end pipes, said direct coupling consisting of an outwardly deformation of said tubing ends in a non-perforate manner into close engagement with an interior of said end pipes to non-removably lock said end pipes to said tubing and to position said terminal ends of said tubing radially outward of said diameter of said second end portion of said end pipes, whereby said terminal ends of said tubing will be positioned out of a flow path of said particulate bearing fluid to prevent an accumulation of particulates on said terminal ends.

3. A flexible exhaust ducting system for carrying a particulate bearing fluid comprising:

a flexible and expandable tubing with two end sections having open terminal ends;

two rigid end pipes, said end pipes each having a first end portion with an inner diameter greater tan an inner diameter of a second end pipe end portion and greater than an outer diameter of said tubing end sections and an annular portion between said two end portions with a greatest inner diameter greater than said diameter of said first end portion; said tubing end sections being positioned relative to each of said end pipes to extend completely through said first end portions and only partly into said annular portions, and said tubing end sections being permanently coupled to said end pipes, said permanent coupling consisting of a radially outwardly deformation of said tubing end sections in a non-perforate manner into conformance with a shape of said end pipes in a non-removably locked manner to prevent relative axial and rotational movement of the tubing and end pipes to locate said tubing terminal ends radially outward of said diameter of said second portion, whereby said terminal ends of said tubing will be positioned out of a flow path of said particulate bearing fluid to prevent an accumulation of particulates on said terminal ends.

4. A flexible exhaust ducting system according to claim 3, wherein said permanent deformation of said tubing ends consists of a cold rolled open end of said tubing ends.

5. A flexible exhaust ducting system according to claim 1, wherein said end pipes have an enlarged diameter portion positioned axially between two relatively smaller diameter portions, and said tubing is radially deformed outwardly into said enlarged diameter portion so as to lock said tubing to said end pipes.

* * * * *